US005964319A

United States Patent [19]

Weingarden

[11] Patent Number: 5,964,319

[45] Date of Patent: Oct. 12, 1999

[54] REMOTE-OPERATED ELEVATOR DOOR SAFETY CONTROL

[76] Inventor: Alison E. Weingarden, 292 Myrtle St., Haworth, N.J. 07641

[21] Appl. No.: 09/031,164

[22] Filed: Feb. 26, 1998

Related U.S. Application Data

[60] Provisional application No. 60/048,612, Jun. 4, 1997.

[51] Int. Cl.[6] ..... B66B 13/14

[52] U.S. Cl. ..... 187/314; 187/324

[58] Field of Search ..... 187/314, 316, 187/324, 334; 49/116, 120

[56] References Cited

U.S. PATENT DOCUMENTS 5,655,627 8/1997 Horne et al. ..... 187/314

*Primary Examiner*—Kenneth W. Noland

*Attorney, Agent, or Firm*—Arthur Jacob

[57] ABSTRACT

A remote-operated elevator door safety control for holding open a door of an elevator from a remote location includes a transmitter remote from the elevator for selectively transmitting a door-open signal, a receiver at the elevator for receiving the door-open signal, and an actuator coupled with the receiver and responsive to the door-open signal to hold a door-operating mechanism in a door-open mode so as to hold the door open in response to reception of the door-open signal.

5 Claims, 2 Drawing Sheets

REMOTE-OPERATED ELEVATOR DOOR SAFETY CONTROL

This application claims the benefit of provisional application Ser. No. 60/048,612, filed Jun. 4, 1997.

The present invention relates generally to the control of elevator doors and pertains, more specifically, to a remote-operated elevator door safety control for enabling the selective holding open of an elevator door to facilitate elevator ingress and egress.

Passenger elevators usually are equipped with a push-button operated control for holding the elevator door open during the 1t ingress or egress of passengers or other loads. These door-hold switches generally are found on a control panel inside the elevator cab and are actuated by a passenger already in the cab. Once actuated, a door-hold switch ordinarily will cause the elevator door to remain open for a relatively short interval. Other devices are made available for preventing an elevator door from closing on a passenger or an object in the doorway of an elevator cab. Thus, light beams and proximity switches will detect the presence of a passenger or an object in the elevator doorway and will hold the elevator door open until the doorway is clear, and even for a prescribed timed interval subsequent to clearing the doorway.

The present invention provides a remote control device which enables an elevator door to be controlled from a distance so that a passenger is able to hold open the elevator door from a location remote from the elevator. In this manner, the elevator door is held open to assist a passenger carrying a bulky load, or while maneuvering a wheeled item, such as a shopping cart or a baby carriage, onto the elevator, for taking on or off a load which may require more than one trip onto the elevator, or for accommodating a passenger confined to a wheelchair. The remote control not only enables a passenger to hold the elevator door open while entering the elevator, but the door can be held open from a distance so as to accommodate a variety of situations where safety is served by such remote control of the elevator door.

Accordingly, the present invention attains several objects and advantages, some of which are summarized as follows: Enables an elevator door to be held open from a remote location, outside the elevator, for facilitating entry into the elevator; accommodates passengers carrying a bulky load onto an elevator, or a load which must be placed on or off the elevator in more than one trip; facilitates the entry and exit of wheeled carriers, such as shopping carts and baby carriages by holding open the elevator door from outside the elevator; assists an elevator passenger confined to a wheelchair in getting on and off an elevator; facilitates the operation of elevator doors in hospitals where wheeled patients must be transported with ease and without undue delay; assists hospital workers, refuse collectors, mail room workers and maintenance personnel in hotels, apartment buildings and office buildings where bulky carts and the like must be maneuvered onto and off of elevators; assists disabled persons in the use of elevators; promotes safety in the operation of elevator doors by enabling an elevator door to be held open from a remote location outside the elevator, as well as more conveniently from within the elevator itself; provides a simple and relatively inexpensive remote-operated elevator door control easily adapted to current elevator construction, and readily retrofitted to existing elevators with minimal cost.

The above objects and advantages, as well as further objects and advantages, are attained by the present invention which may be described briefly as a remote-operated elevator door safety control for holding open a door of an elevator from a remote location, the elevator door having a door-operating mechanism for actuation between a door-open mode and door-close mode to move the door selectively to an open position and to a closed position, respectively, and a door-open switch for selectively holding the door-operating mechanism in the door-open mode, the safety control comprising: a transmitter remote from the elevator for selectively transmitting a door-open signal; a receiver at the elevator for receiving the door-open signal; and an actuator coupled with the receiver and responsive to the door-open signal to hold the door-operating mechanism in the door-open mode in response to reception of the door-open signal.

The invention will be understood more fully, while still further objects and advantages will become apparent, in the following detailed description of a preferred embodiment of the invention illustrated in the accompanying drawing, in which.

Figure 1:
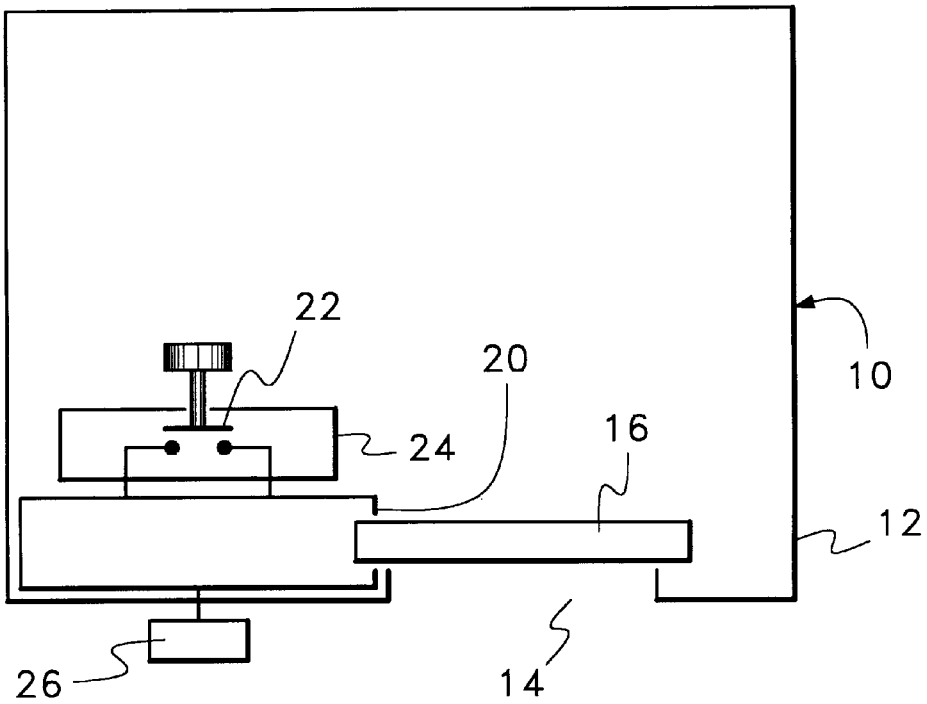
Fig. 1 (Prior Art)
FIG. 1 is a diagrammatic illustration, in a generally plan view, of a conventional door-operating system in a passenger elevator.
Figure 2:
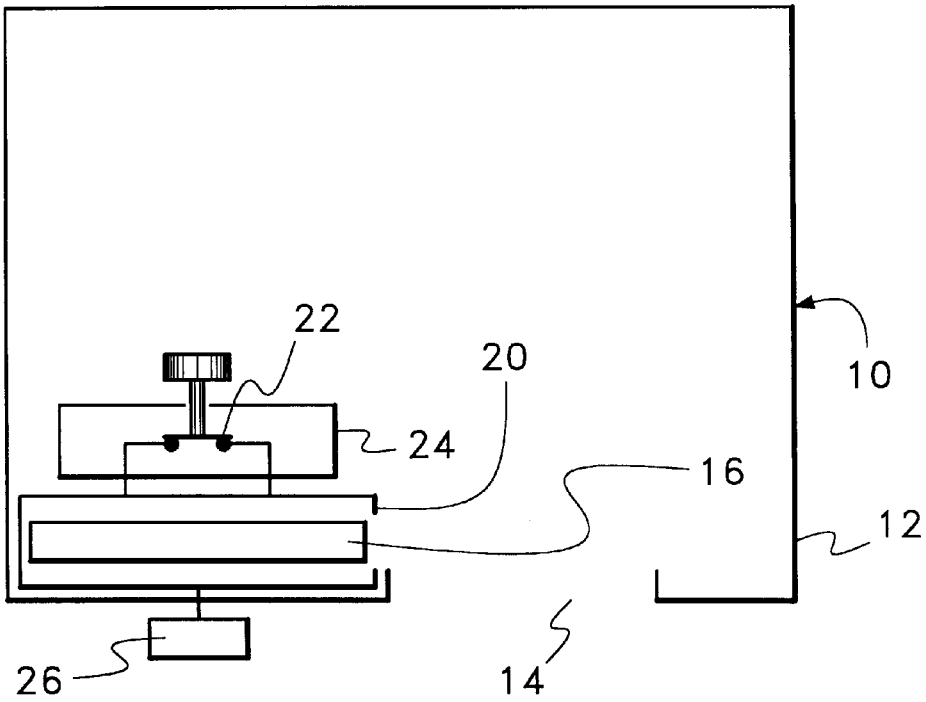
Fig. 2 (Prior Art)
FIG. 2 is a diagrammatic illustration similar to FIG. 1 and showing another mode of operation.

Referring now to the drawing, and especially to FIGS. 1 and 2 thereof, an elevator is illustrated diagrammatically at 10 and is seen to include an elevator cab 12 having a passenger doorway 14 and a door 16. A door-operating system includes a door-operating mechanism 20 which is coupled with the door 16 and is actuated to operate between a door-close mode, as illustrated in FIG. 1, and a door-open mode, as seen in FIG. 2. A door-hold switch 22 is connected to the door-operating mechanism 20 such that when the door-hold switch 22 is open, as shown in FIG. 1, the door-operating mechanism 20 moves and holds the door 16 in a closed position over the doorway 14, and when the door-hold switch 22 is closed, as seen in FIG. 2, the door-operating mechanism 20 moves and holds the door 16 in an open position wherein the doorway 14 is open for entry into and exit from the cab 12, all in a now-conventional manner. The door-hold switch 22 usually is a push-button switch located on a control panel 24 inside the cab 12 so that the switch 22 is accessible only from the interior of the cab 12 and holds the door 16 open only while being depressed, or for a relatively short timed interval subsequent to actuation. In some elevators, a door-hold switch is constructed so that once placed in the door-open mode, the switch remains in the door-open mode until moved manually back to the door-close mode, thereby enabling entry to and exit from the elevator for as long as the switch remains in the door-open mode. These arrangements do not allow a passenger to operate the elevator door 16 from any location other than in close proximity to the switch 22 or to the elevator call switch 26 which also is placed at a fixed location, either very near or close to the elevator 10.

Figure 3:
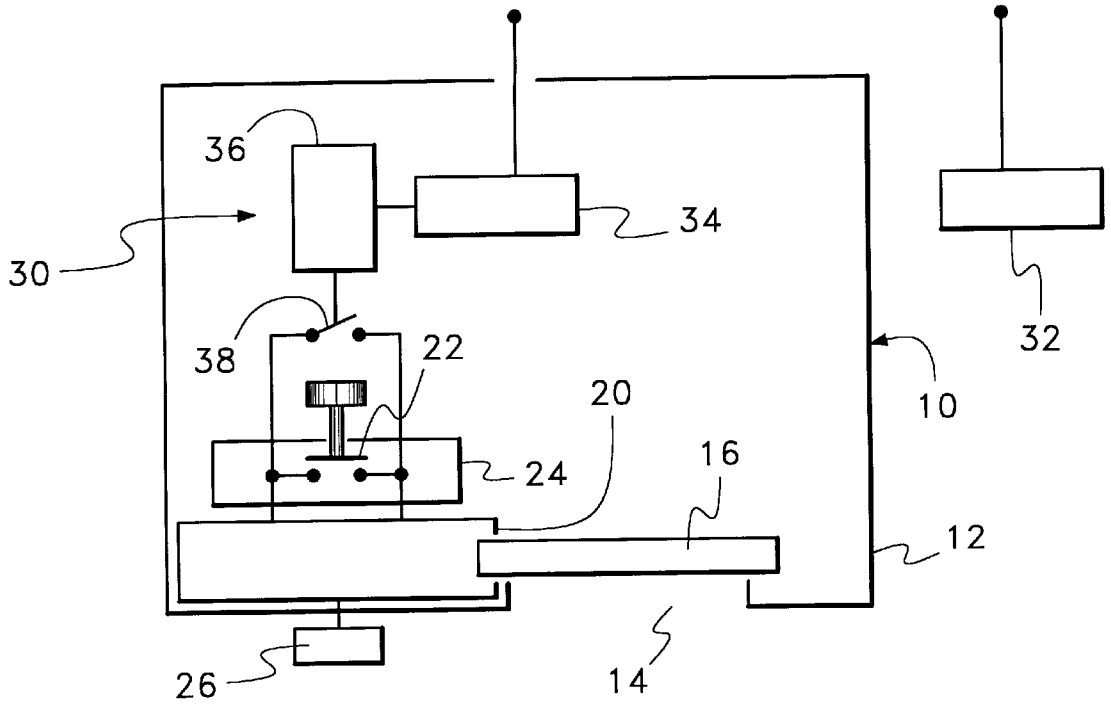
FIG. 3 is a diagrammatic illustration similar to FIG. 1 and showing a remote-operated elevator door safety control constructed in accordance with the present invention.
Figure 4:
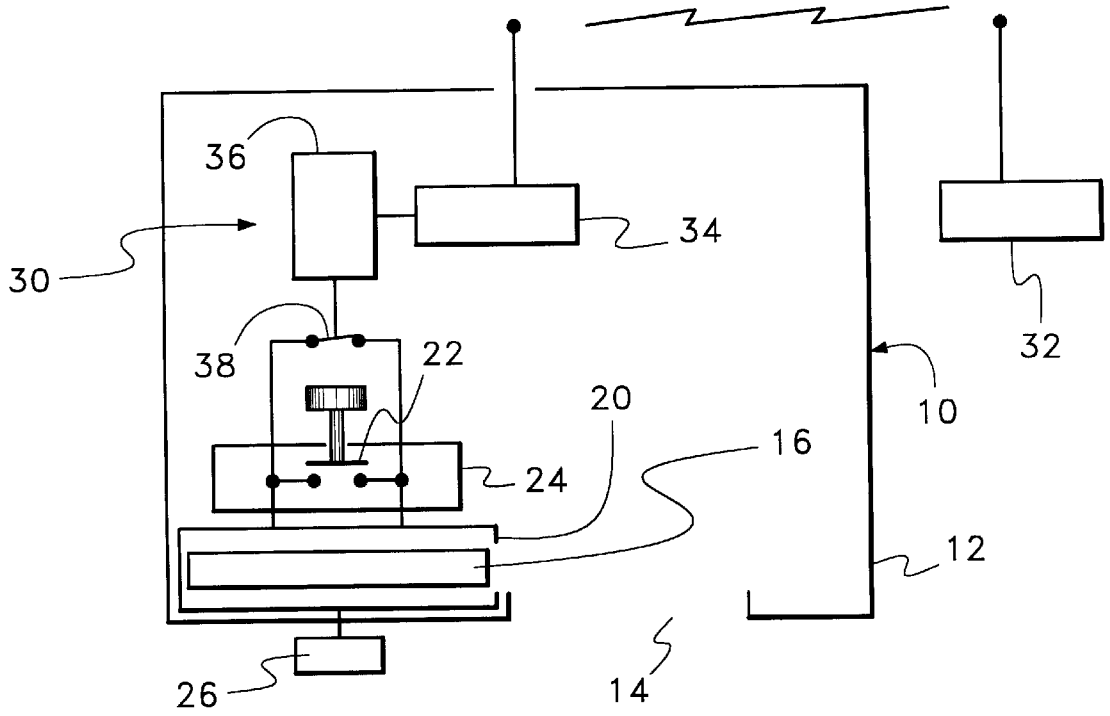
FIG. 4 is a diagrammatic illustration similar to FIG. 3 and showing another mode of operation.

Turning now to FIGS. 3 and 4, the present invention provides elevator 10 with a remote-operated elevator door safety control 30 which enables the door 16 of the elevator cab 12 to be operated so as to be held open from a location remote from the elevator 10. Thus, remote-operated elevator door safety control 30 includes a transmitter in the form of a hand-held radio frequency transmitter 32 readily carried by a passenger (not shown) who selectively activates the transmitter 32 to transmit a radio frequency door-open signal. A receiver 34 is located at the elevator 10 for receiving the door-open signal. An actuator in the form of a relay 36 is coupled to the receiver 34 and includes a relay switch 38 connected in parallel with the door-hold switch 22, as seen in FIG. 3, wherein the relay switch 38 is illustrated in a door-close mode and the door 16 is, in fact, closed.

When the transmitter 32 is activated to transmit the door-open signal, the receiver 34 receives the door-open signal and the relay 36 is actuated to close the relay switch 38, as shown in FIG. 4, wherein the relay switch 38 is illustrated in a door-open mode. The door-operating mechanism 20 then moves the door 16 to the open position and retains the door 16 in the open position as long as the door-open signal is being received by the receiver 34. Once the door-open signal is discontinued, the relay switch 38 is opened and the door-operating mechanism 20 moves the door 16 to the closed position, as shown in FIG. 3. The radio frequency transmitter 32 is omnidirectional so that the transmission of the door-open signal is attained in a reliable fashion without regard to persons or objects passing between the transmitter 32 and the receiver 34. The range of the transmitter 32 is limited so that should the passenger leave the vicinity of the elevator 10, with the transmitter 32 turned on and transmitting the door-open signal, the relay switch 38 will be returned to the door-close mode by virtue of the receiver 34 no longer receiving the out-of-range signal, and the elevator door 16 will be returned for normal operation in response to the door-hold switch 22.

It will be seen that the present invention attains the several objects and advantages summarized above, namely: Enables an elevator door to be held open from a remote location, outside the elevator, for facilitating entry into the elevator; accommodates passengers carrying a bulky load onto an elevator, or a load which must be placed on or off the elevator in more than one trip; facilitates the entry and exit of wheeled carriers, such as shopping carts and baby carriages by holding open the elevator door from outside the elevator; assists an elevator passenger confined to a wheelchair in getting on and off an elevator; facilitates the operation of elevator doors in hospitals where wheeled patients must be transported with ease and without undue delay; assists hospital workers, refuse collectors, mail room workers and maintenance personnel in hotels, apartment buildings and office buildings where bulky carts and the like must be maneuvered onto and off of elevators; assists disabled persons in the use of elevators; promotes safety in the operation of elevator doors by enabling an elevator door to be held open from a remote location outside the elevator, as well as more conveniently from within the elevator itself; provides a simple and relatively inexpensive remote-operated elevator door control easily adapted to current elevator construction, and readily retrofitted to existing elevators with minimal cost.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A remote-operated elevator door safety control for holding open a door of an elevator from a remote location, the elevator door having a door-operating mechanism for actuation between a door-open mode and door-close mode to move the door selectively to an open position and to a closed position, respectively, and a door-open switch for selectively holding the door-operating mechanism in the door-open mode, the safety control comprising:

a transmitter remote from the elevator for selectively transmitting a door-open signal;

a receiver at the elevator for receiving the door-open signal; and an actuator coupled with the receiver and responsive to the door-open signal to hold the door-operating mechanism in the door-open mode in response to reception of the door-open signal.

2. The invention of claim 1 wherein the transmitter is a radio frequency transmitter and the receiver is a radio frequency receiver.

3. The invention of claim 1 wherein the actuator is constructed to maintain the door-operating mechanism in the door-open mode during reception of the door-open signal and returns the door-operating mechanism to the door-close mode upon discontinuance of the reception of the door-open signal.

4. The invention of claim 1 wherein the actuator includes a relay responsive to the door-open signal, the relay including a switch in parallel with the door-hold switch for holding the door-operating mechanism in the door-open mode independent of the door-hold switch.

5. The invention of claim 4 wherein the transmitter is a radio frequency transmitter and the receiver is a radio frequency receiver.

* * * * *